US007783227B2

(12) United States Patent
Sugimoto

(10) Patent No.: US 7,783,227 B2
(45) Date of Patent: Aug. 24, 2010

(54) IMAGE FORMATION APPARATUS WITH POSITIONING SECTION THAT POSITIONS EXPOSURE DEVICE

(75) Inventor: Tsutomu Sugimoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 894 days.

(21) Appl. No.: 11/542,549

(22) Filed: Oct. 4, 2006

(65) Prior Publication Data

US 2007/0160387 A1 Jul. 12, 2007

(30) Foreign Application Priority Data

Jan. 10, 2006 (JP) ..... P2006-002397

(51) Int. Cl.
*G03G 21/16* (2006.01)

(52) U.S. Cl. ..... 399/111; 399/107; 399/110; 399/112; 399/113; 399/118

(58) Field of Classification Search ..... 399/107, 399/110–113, 118
See application file for complete search history.

(56) References Cited

U.S. PATENT DOCUMENTS 6,249,296 B1 6/2001 Nemura ..... 347/138
6,788,321 B2 9/2004 Araki et al. ..... 347/138
2002/0135655 A1* 9/2002 Ameyama et al. ..... 399/110
2004/0228652 A1 11/2004 Fujiwara ..... 399/117

FOREIGN PATENT DOCUMENTS

| | | | |
|---|---|---|---|
| CN | 1442760 A | | 9/2003 |
| JP | 03033870 A | * | 2/1991 |
| JP | 2002-91268 | | 3/2002 |
| KR | 1998-031959 | | 7/1998 |
| KR | 2000-0035179 | | 6/2000 |

* cited by examiner

*Primary Examiner*—David M Gray
*Assistant Examiner*—Ryan D Walsh
(74) *Attorney, Agent, or Firm*—Morgan, Lewis & Beckius LLP

(57) ABSTRACT

An image formation apparatus comprises: an image formation apparatus main body; plural image formation units being provided detachably in the image formation apparatus main body, each of the image formation units including an image carrier and an exposure device that applies light to the image carrier for writing a latent image onto the image carrier; and a positioning section that positions the exposure device of each of the image formation units relative to the image formation apparatus main body.

10 Claims, 8 Drawing Sheets

10
12
14
16
18
20
22
24
26
28
29
30
32
34
34a
34b
36
38
42
42
46
46
46
46
50
50
50
50
66
68
68a
A
B

IMAGE FORMATION APPARATUS WITH POSITIONING SECTION THAT POSITIONS EXPOSURE DEVICE

BACKGROUND (i) Technical Field

This invention relates to an image formation apparatus of a copier, a facsimile, a printer, etc.

(ii) Related Art

As this kind of image formation apparatus, an image formation apparatus including an image formation unit provided detachably in an apparatus main body and having a photoconductor, an exposure device, etc., in one piece is widely known.

SUMMARY

An image formation apparatus including: an image formation apparatus main body; plural image formation units being provided detachably in the image formation apparatus main body, each of the image formation units including an image carrier and an exposure device that applies light to the image carrier for writing a latent image onto the image carrier; and a positioning section that positions the exposure device of each of the image formation units relative to the image formation apparatus main body. Therefore, the relative position shifts of the exposure devices in the plural image formation units are prevented and occurrence of an image defect is decreased.

BRIEF DESCRIPTION OF THE DRAWINGS

Exemplary embodiments of the present invention will be described in detail based on the following figure, wherein.

DETAILED DESCRIPTION

Referring now to the accompanying drawings, there are shown exemplary embodiments of the invention.

Figure 1:
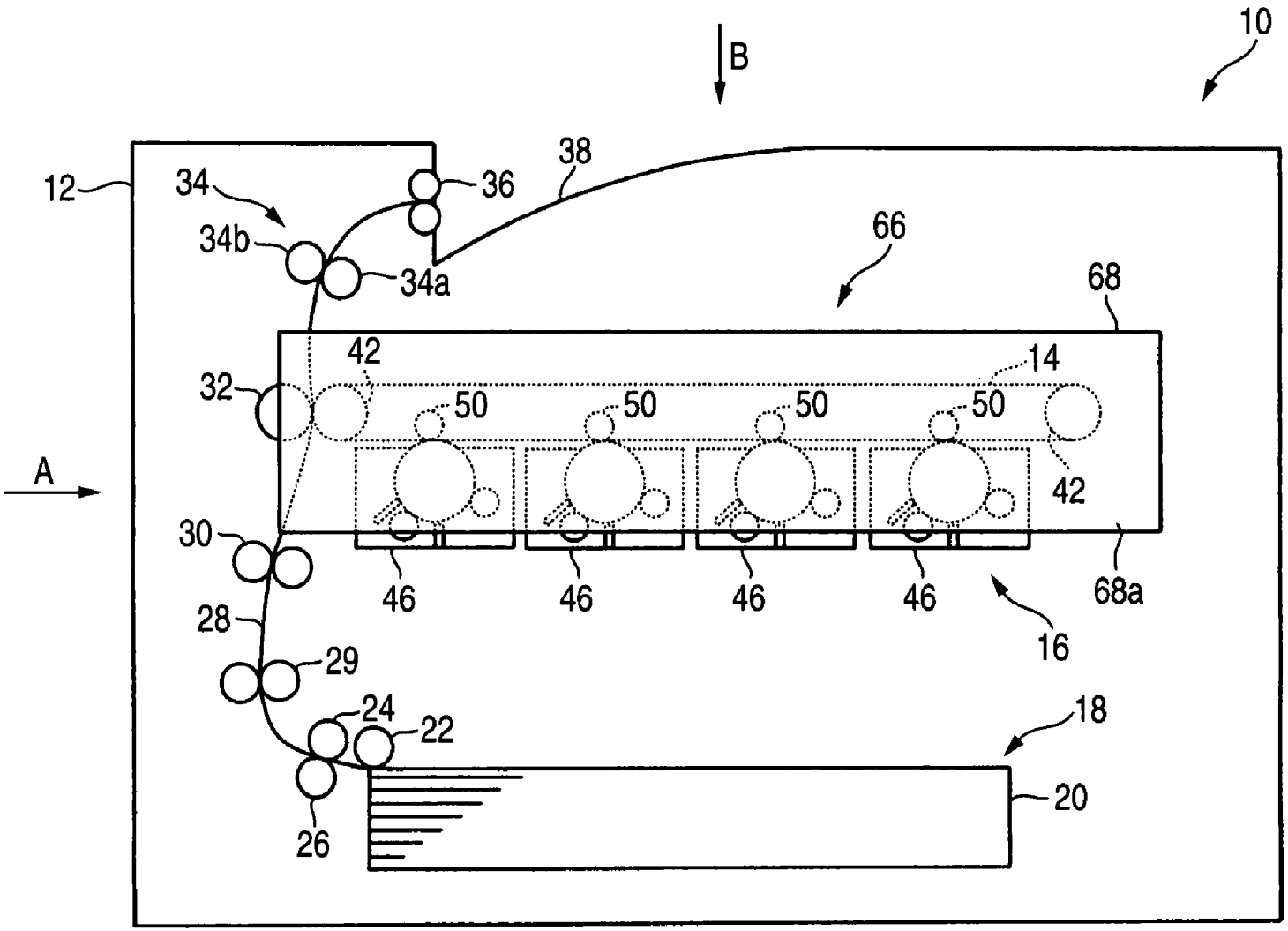
FIG. 1 is a side view to show an image formation apparatus according to an exemplary embodiment of the invention.

FIG. 1 shows an image formation apparatus 10 according to an exemplary embodiment of the invention. This image formation apparatus 10 has an image formation apparatus main body 12 containing an intermediate transfer belt 14 as an intermediate transfer body. For example, four image formation sections 16 are placed side by side on the intermediate transfer belt 14, forming the image formation apparatus 10 as a tandem system. The image formation sections 16 form yellow, magenta, cyan, and black toner images on the intermediate transfer belt 14.

A sheet supply unit 18 is provided below the image formation apparatus main body 12. The sheet supply unit 18 has a sheet supply cassette 20 loaded with sheets, a pickup roll 22 for picking up a sheet loaded on the sheet supply cassette 20, and a feed roll 24 and a retard roll 26 for delivering sheets while handing the sheets. The sheet supply cassette 20 is provided detachably for the image formation apparatus main body 12 so that it can be drawn out in the front direction in the figure; the sheet supply cassette 20 is loaded with sheets as transfer bodies such as ordinary paper and OHP sheets.

A sheet supply passage 28 is provided almost along the vertical direction in the vicinity of one end of the image formation apparatus main body 12 (in the vicinity of the left end in the figure). The sheet supply passage 28 is provided with a transport roll 29, a registration roll 30, a secondary transfer roll 32, a fuser 34, and an ejection roll 36. The registration roll 30 temporarily stops the sheet delivered to the sheet supply passage 28 and sends the sheet to the secondary transfer roll 32 at a proper timing. The fuser 34 is made up of a heating roll 34*a* and a pressurization roll 34*b* for adding heat and pressure to the sheet passing through the nip between the heating roll 34*a* and the pressurization roll 34*b*, thereby fixing a toner image onto the sheet.

An ejection tray 38 is provided in the upper part of the image formation apparatus main body 12. The sheet with the toner image fixed thereon is ejected to the ejection tray 38 by the ejection roll 36 and is stacked on the ejection tray 38. Therefore, the sheets in the sheet supply cassette 20 are ejected to the ejection tray 38 in order through the pass shaped like a letter C.

Each of the image formation sections 16 is made up of an image formation unit 46 provided on one face of the intermediate transfer belt 14 and a primary transfer roll 50 provided on the back of the intermediate transfer belt 14. The image formation unit 46 is provided detachably for the image formation apparatus main body 12 and can be drawn out in the front direction in FIG. 1 after it is once moved downward.

Figure 2:
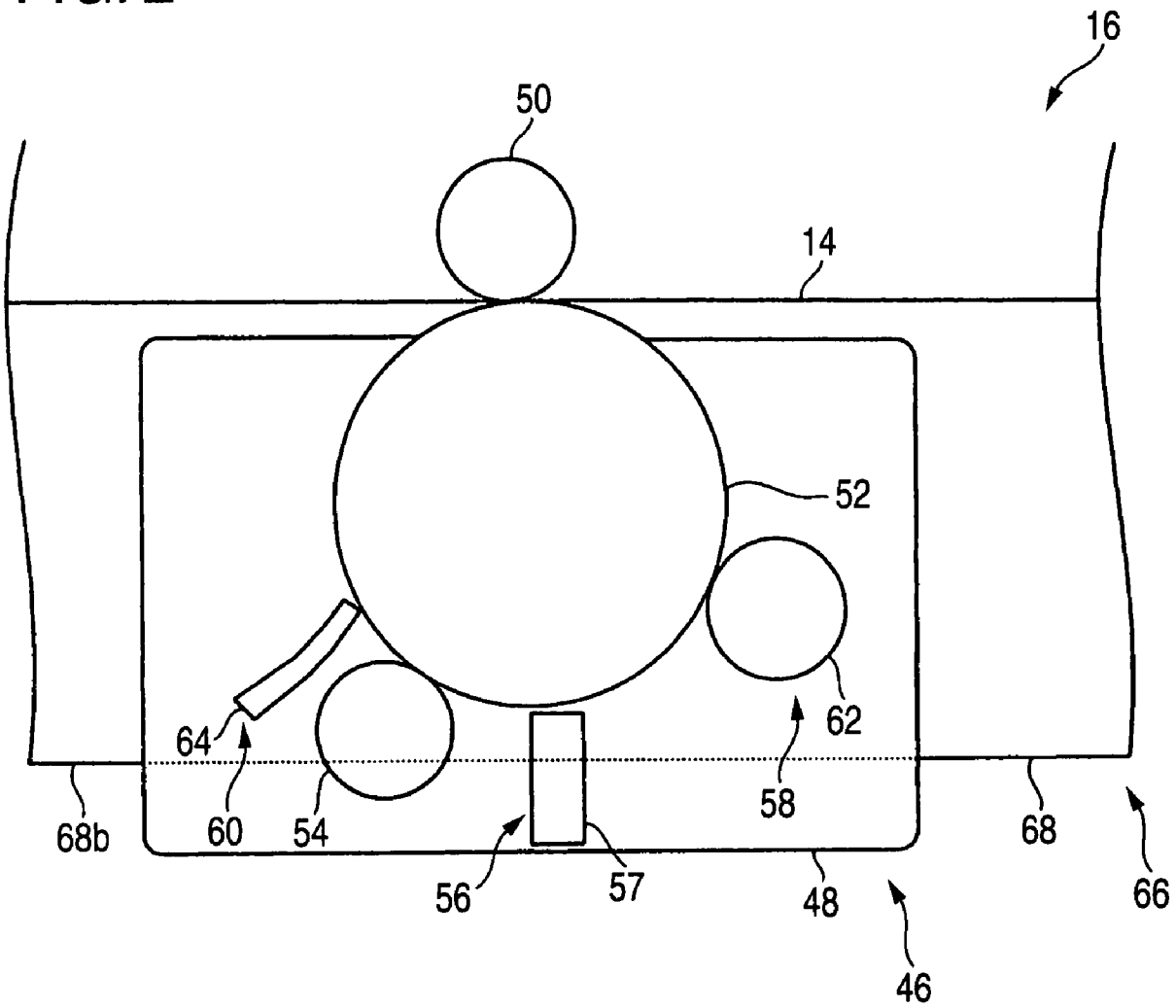
FIG. 2 is a drawing to show an image formation section according to the exemplary embodiment of the invention.

FIG. 2 shows the details of the image formation sections 16. The image formation unit 46 has an image formation unit main body 48 and includes a photoconductor 52 opposed to the intermediate transfer belt 14, a charging device 54 implemented as a roll, for example, for charging the photoconductor 52, an exposure device 56 implemented as a light emitting diode (LED) array, for example, for forming (writing) a latent image on (onto) the photoconductor 52, a developing device 58 for developing the latent image formed on the photoconductor 52 by the exposure device 56 in toner, and a cleaner 60 for cleaning the remaining toner on the photoconductor 52 after transfer, the components being housed in the image formation unit main body 48.

The developing device 58 uses a developer made up of toner and carriers in a dual-component system, for example, and has a developing roll 62. The developing roll 62 is formed with a magnetic brush of carriers for transporting toner deposited on the carriers and developing the latent image on the photoconductor 52 in the toner.

The cleaner 60 has a toner scraping section 64 made of a blade, for example, for scraping the toner off the surface of the photoconductor 52.

As shown in FIG. 1, the intermediate transfer belt 14 is supported on plural transport rolls 42 and the belt face where the image formation sections 16 are provided is placed in the horizontal direction. One of the transport rolls 42 forms a backup roll of the secondary transfer roll 32.

The intermediate transfer belt 14, the transport rolls 42, and the primary transfer rolls 50 are integrated into one body as an intermediate transfer unit 66. The intermediate transfer unit 66 has an intermediate transfer unit main body 68. The transport rolls 42 and the primary transfer rolls 50 are placed in the intermediate transfer unit main body 68 for rotation, and the intermediate transfer belt 14 is stretched between the transport rolls 42. That is, the intermediate transfer unit main body 68 is implemented as a support member for supporting the intermediate transfer belt 14, etc. The intermediate transfer unit 66 can be attached to and detached from the image formation apparatus main body 12 can be drawn out in the front direction in FIG. 1.

The intermediate transfer unit main body 68 has a side plate 68*a* on the front side in the figure (shown in FIG. 1) and a side plate 68*b* on the depth side in the figure (shown in FIG. 2) with the side plates joined by a top plate. The intermediate transfer unit main body 68 is formed with an opening downward to allow parts of the image formation units 46 to be inserted into the opening.

In the described configuration, the intermediate transfer belt 14 and the photoconductor 52 rotate in synchronization with each other, the charging device 54 charges the surface of the photoconductor 52, and the exposure device 56 forms a latent image. The latent image formed on the photoconductor 52 by the exposure device 56 is developed by the developing device 58. The toner image developed by the developing device 58 is transferred to the intermediate transfer belt 14 by the primary transfer roll 50. The color toner images formed by the image formation sections 16 are superposed on each other with a move of the intermediate transfer belt 14.

On the other hand, the sheets stacked in the sheet supply cassette 20 of the sheet supply unit 18 are delivered one at a time to the sheet supply passage 28 by the pickup roll 22, the feed roll 24, the retard roll 26, etc. The sheet delivered to the sheet supply passage 28 abuts the registration roll 30, is temporarily stopped, and is sent to the secondary transfer roll 32 at a proper timing. The toner image on the intermediate transfer belt 14 is transferred to the sheet by the secondary transfer roll 32. The sheet to which the toner image is transferred is further sent to the fuser 34, and the toner image is fixed onto the sheet by heat and pressure. The sheet where the toner image is fixed by the fuser 34 is ejected to the ejection tray 38 by the ejection roll 36.

Figure 3:
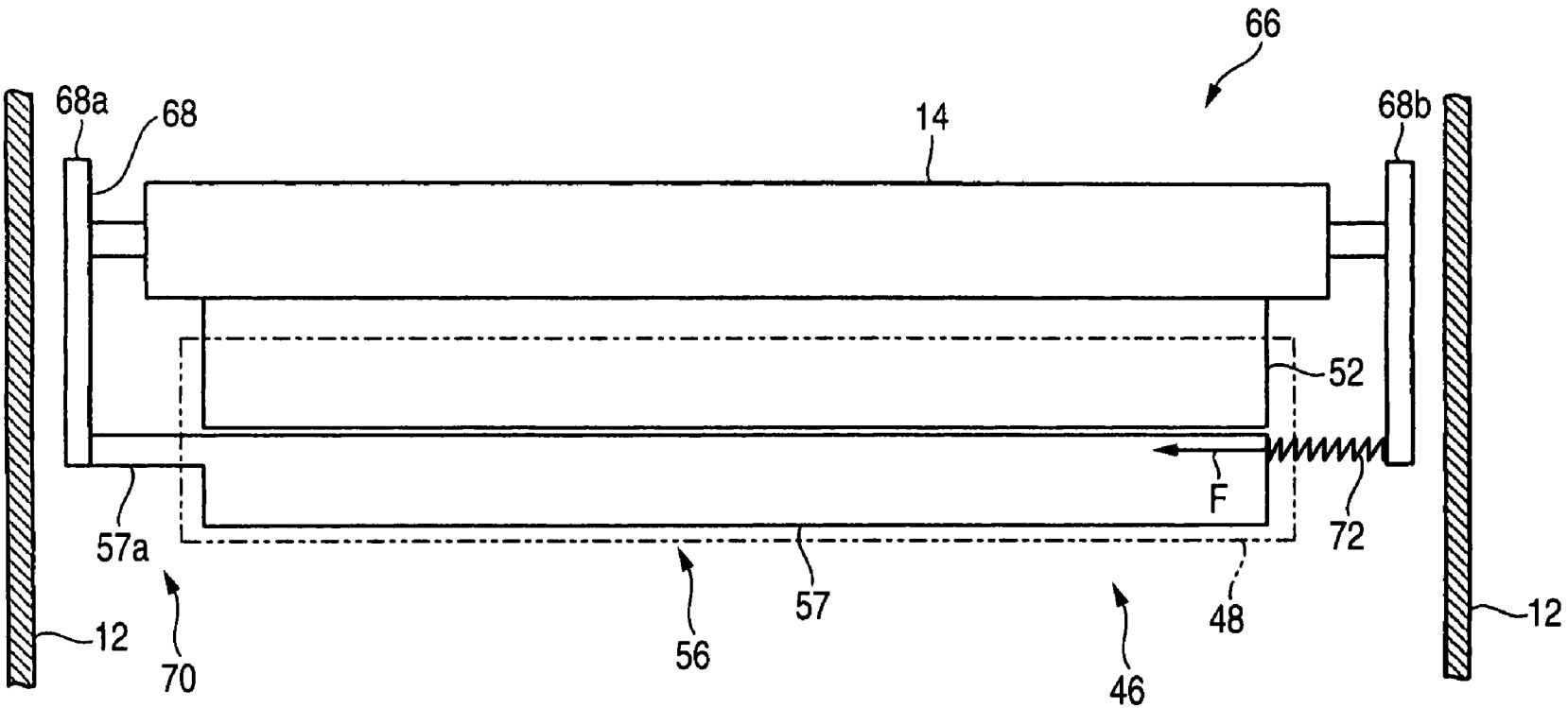
FIG. 3 is a longitudinal sectional view to show an image formation unit according to the exemplary embodiment of the invention.
Figure 4:
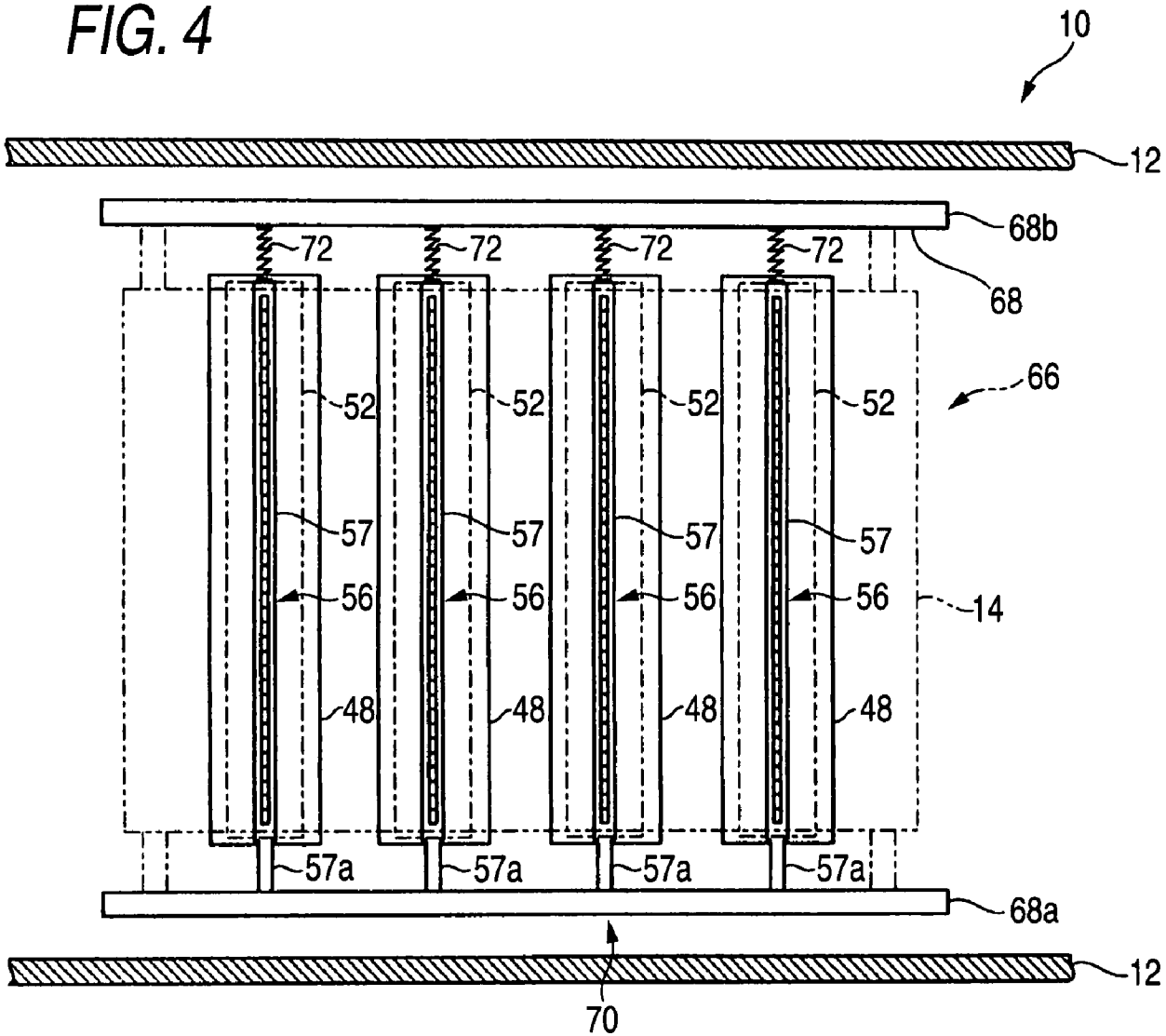
FIG. 4 is a lateral sectional view to show plural image formation units according to the exemplary embodiment of the invention.

FIGS. 3 and 4 show the image formation unit 46 placed in the image formation apparatus main body 12. FIG. 3 is a longitudinal sectional view from one side of the image formation apparatus main body 12 (arrow A direction in FIG. 1). As shown in FIG. 3, the exposure device 56 has an exposure device main body 57, which is provided movably only at a predetermined distance in the fast scanning direction relative to the image formation unit 48. A positioning section 70 is made up of a convex part 57*a* formed at one end of the exposure device main body 57 in the fast scanning direction as a first positioning part and a side plate 68*a* of the intermediate transfer unit main body 68 as a second positioning part. A coil spring 72 as an urging section is disposed between an opposite end where the convex part 57*a* of the exposure device main body 57 is not formed and a side plate 68*b* of the intermediate transfer unit main body 68.

When the image formation unit 46 is placed in the image formation apparatus main body 12, the image formation unit 46 is positioned relative to the image formation apparatus main body 12 (not shown). At this time, the exposure device 56 is positioned relative to the intermediate transfer unit 66 as the convex part 57*a* of the exposure device main body 57 abuts the side plate 68*a* of the intermediate transfer unit main body 68 by the urging force of the coin spring 72 (arrow F in FIG. 3).

FIG. 4 is a lateral sectional view from the top face of the image formation apparatus main body 12 (arrow B direction in FIG. 1). As shown in FIG. 4, the convex parts 57*a* of the exposure device main bodies 57 for yellow, magenta, cyan, and black colors abut the side plate 68*a* of the intermediate transfer unit main body 68, whereby the exposure devices 56 are positioned relative to the intermediate transfer unit 66.

Figure 8:
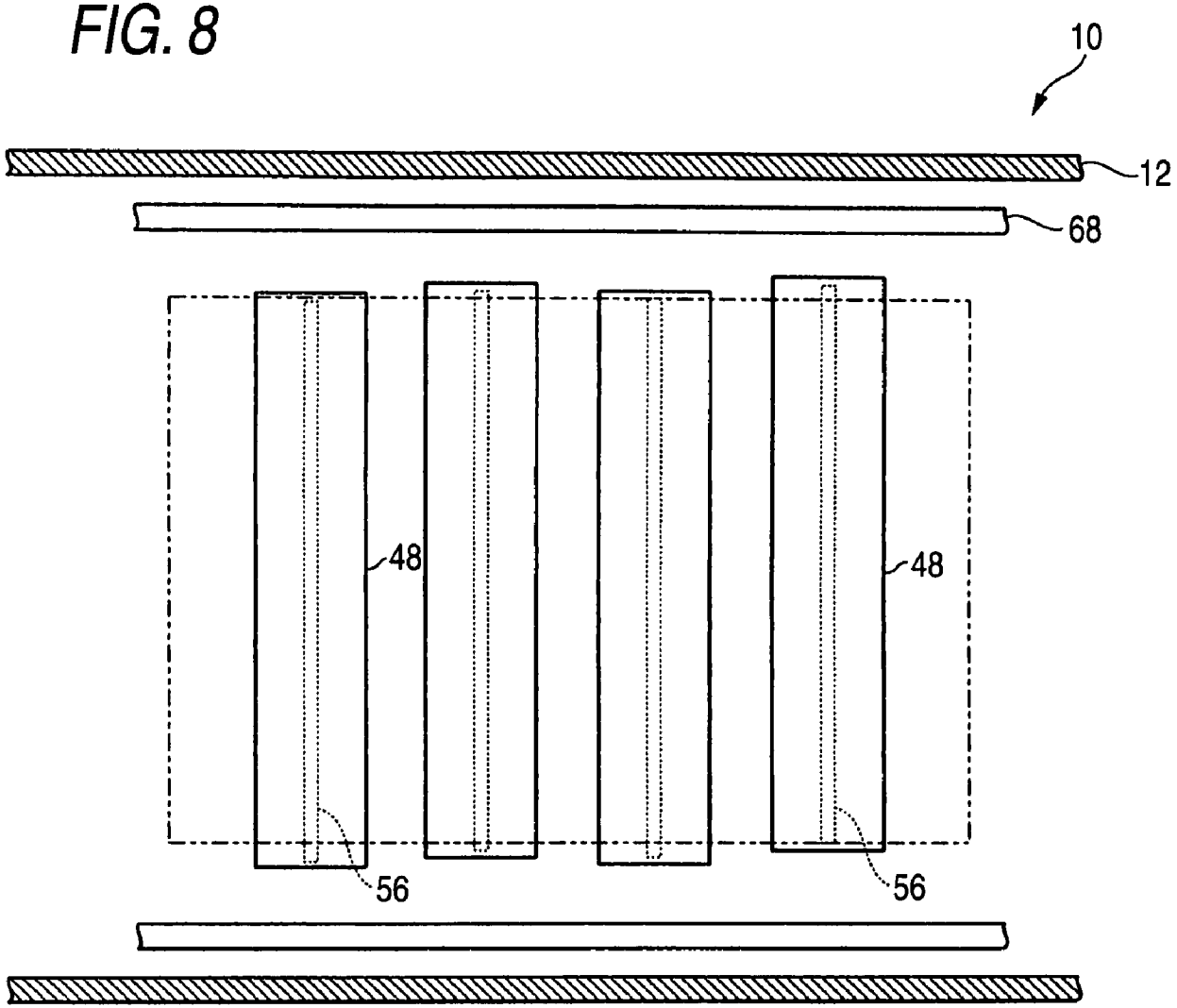
FIG. 8 is a lateral sectional view of an image formation apparatus with exposure devices positioned at image formation units in a comparison example.

FIG. 8 is a lateral sectional view to show an image formation apparatus 10 with exposure devices 56 positioned at image formation unit main bodies 48 in a comparison example. As shown in FIG. 8, the positions of an image formation apparatus main body 12 and the image formation unit main bodies 48 may change, for example, because of the accumulation of an error occurring in positioning the exposure device 56 relative to the image formation apparatus main body 12 and an error occurring in positioning the exposure device 56 relative to the image formation unit main bodies 48, deformation of the image formation unit main bodies 48, a difference in the engagement positions of drive gears (not shown) of photoconductors 52 housed in the image formation unit main bodies 48, or the like. The positioning error between the image formation apparatus main body 12 and each image formation unit main body 48 causes a relative position shift to occur in each exposure device 56.

In contrast, in the image formation apparatus 10 of the exemplary embodiment, the convex parts 57*a* of the exposure device main bodies 57 abut the side plate 68*a* of the intermediate transfer unit main body 68, whereby the exposure devices 56 are positioned relatively and if the positions of the image formation apparatus main body 12 and the image formation units 46 change as in the comparison example shown in FIG. 8, occurrence of an image defect of a color shift, etc., can be decreased.

The convex parts 57*a* of the exposure device main bodies 57 abut the side plate 68*a* of the intermediate transfer unit main body 68, whereby the exposure devices 56 are positioned relative to the intermediate transfer unit 66, so that the position shift of the toner images superposed on each other on the intermediate transfer belt 14 is decreased.

Figure 5:
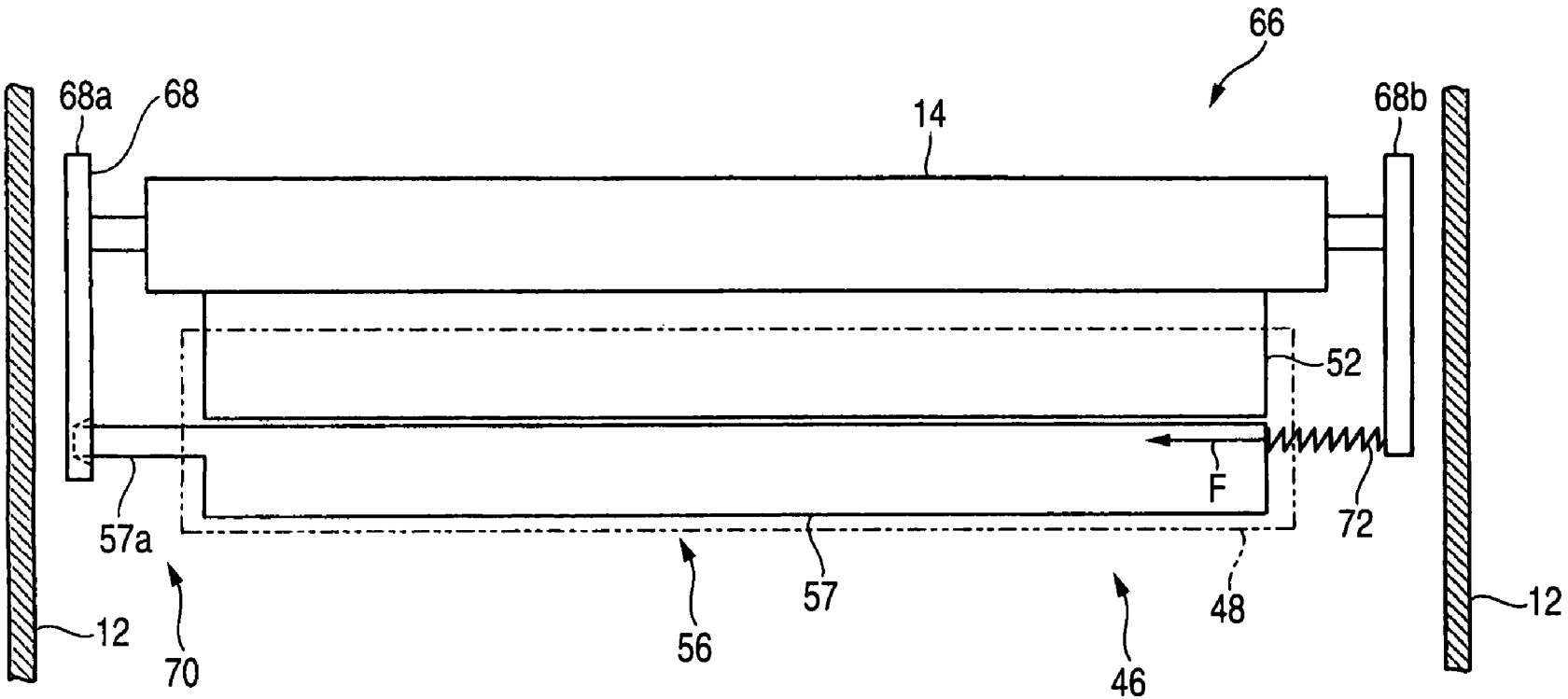
FIG. 5 is a longitudinal sectional view to show another example of an image formation unit according to the exemplary embodiment of the invention.

As shown in FIG. 5, the side plate 68*a* as the second positioning part may have concave portions to receive the respective convex parts 57*a*, thus providing positioning in a slow scanning direction in addition to the fast scanning direction.

The exposure device main bodies 57 are not fixed to the image formation unit main bodies 48 and further are urged against the intermediate transfer unit main body 68 by the coil spring 72, so that vibration of the developing devices 58, etc., transmitted to the exposure devices 56 is decreased and occurrence of an image defect of banding, etc., can be suppressed.

If the positions of the photoconductor 52 and the exposure device 56 change, change in the absolute positions of the photoconductor 52 and the exposure device 56 can be adjusted by registration control (transport control of the registration roll 30, the transport roll 29, etc., light emission timing control of the exposure device 56, etc.,) or the like.

In the description of the exemplary embodiment, the exposure device main bodies 57 abut the side plate 68*a* of the intermediate transfer unit main body 68, whereby the exposure devices 56 are positioned, but the invention is not limited to the mode. The convex parts 57*a* of the exposure device main bodies 57 may be abutted against a frame (not shown) of the intermediate transfer belt 14, a frame of a sheet transport belt unit (not shown) if the intermediate transfer belt 14 is not used, or the like for positioning the exposure devices 56.

Next, a second exemplary embodiment of the invention will be discussed based on FIG. 6.

Figure 6:
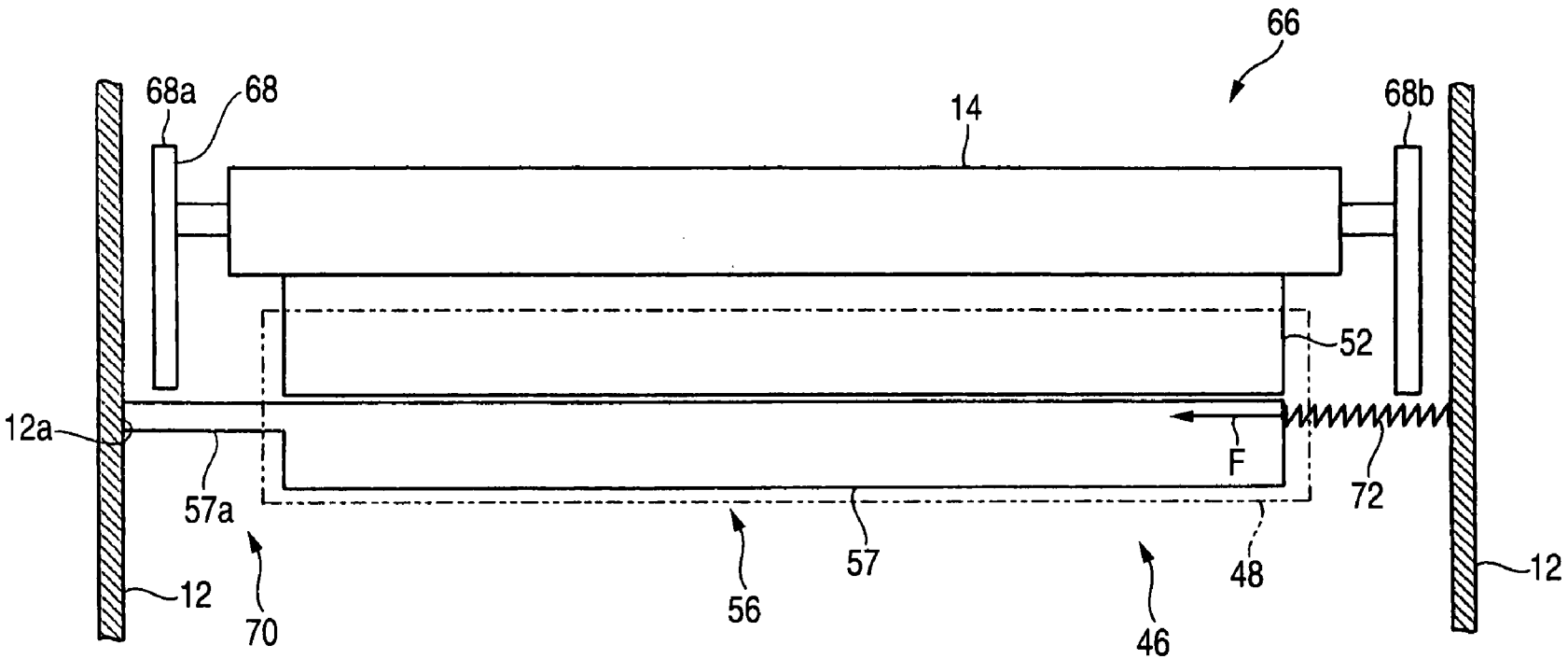
FIG. 6 is a longitudinal sectional view to show an image formation unit according to a second exemplary embodiment of the invention.

As shown in FIG. 6, a positioning section 70 is made up of a convex part 57*a* formed at one end of an exposure device main body 57 in the fast scanning direction as a first positioning part and a part of an image formation apparatus main body 12 as a second positioning part (an abutted part 12*a* in FIG. 6). A coil spring 72 as the urging section is disposed between an opposite end where the convex part 57*a* of the exposure device main body 57 is not formed and a side plate 68*b* of an intermediate transfer unit main body 68.

When an image formation unit 46 is placed in the image formation apparatus main body 12, the image formation unit 46 is positioned relative to the image formation apparatus main body 12 (not shown). At this time, an exposure device 56 is positioned relative to the image formation apparatus main body 12 as the convex part 57*a* of the exposure device main body 57 abuts the part of the image formation apparatus main body 12 (abutted part 12*a*) by the urging force of the coin spring 72 (arrow F in FIG. 6).

Thus, the convex parts 57*a* of the exposure device main bodies 57 abut the part of the image formation apparatus main body 12 (abutted part 12*a*), whereby the exposure devices 56 are positioned relatively and if the positions of the image formation apparatus main body 12 and the image formation units 46 change, occurrence of an image defect of a color shift, etc., can be decreased.

Figure 7:
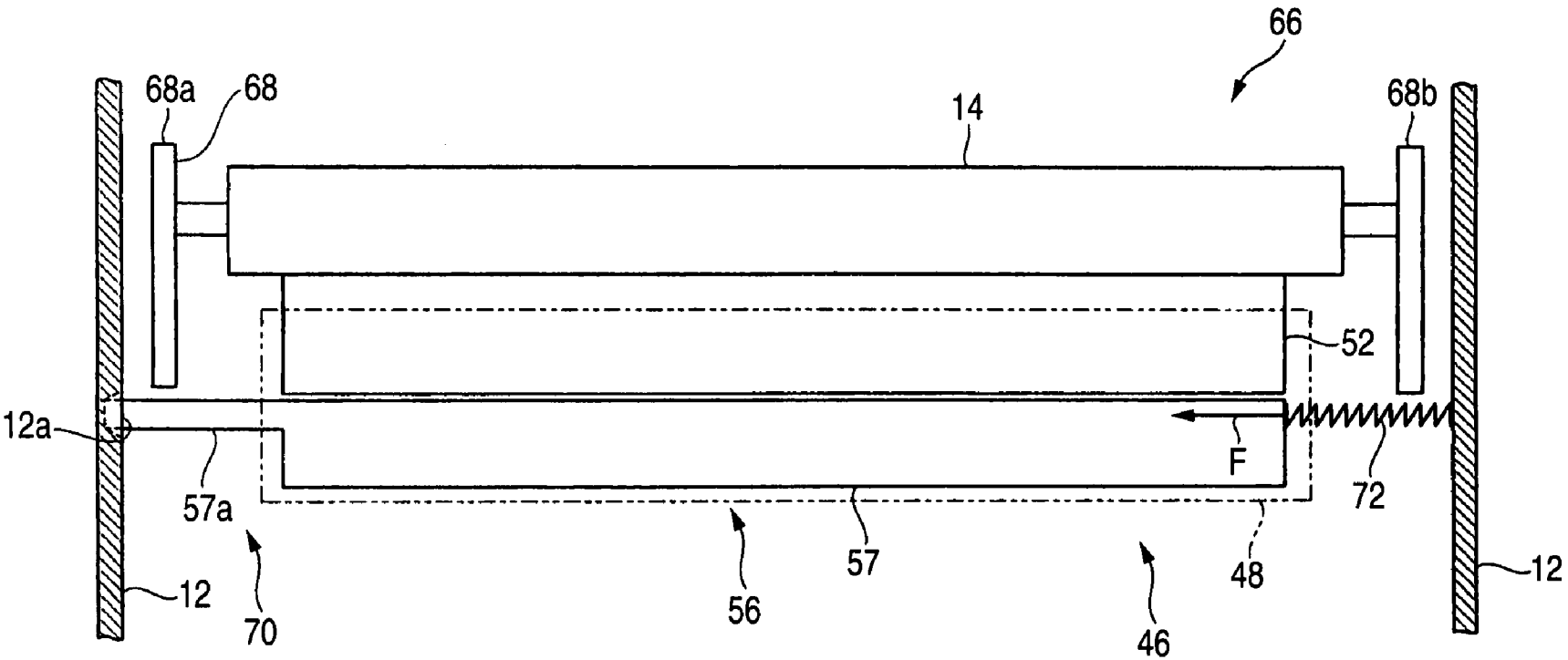
FIG. 7 is a longitudinal sectional view to show another example of an image formation unit according to the second exemplary embodiment of the invention.

As shown in FIG. 7, the abutted part 12*a* as the second positioning part may have concave portions to receive the respective convex parts 57*a*, thus providing positioning in a slow scanning direction in addition to the fast scanning direction.

The exposure device main bodies 57 are not fixed to image formation unit main bodies 48 and further are urged against the image formation apparatus main body 12 by the coil spring 72, so that vibration of developing devices 58, an intermediate transfer unit 66, etc., transmitted to the exposure devices 56 is decreased and occurrence of an image defect of banding, etc., can be more suppressed.

As described above, the invention can be applied to an image formation apparatus with plural image formation units each having an image carrier and an exposure device, for example.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image formation apparatus comprising:

an image formation apparatus main body;

a plurality of image formation units being provided detachably in the image formation apparatus main body, each of the image formation units comprising an image carrier and an exposure device that applies light to the image carrier for writing a latent image onto the image carrier; and a positioning section that positions the exposure device of each of the image formation units relative to the image formation apparatus main body, wherein the positioning section comprises: first positioning parts each formed in the exposure device; and a second positioning part formed in the image formation apparatus main body, and the positioning section positions the exposure device relative to the image formation apparatus main body by causing the first positioning parts and the second positioning part to abut each other.

2. The image formation apparatus as claimed in claim 1, wherein the positioning section further comprises an urging member that urges each of the first positioning parts toward the second positioning part.

3. The image formation apparatus as claimed in claim 1, wherein each of the first positioning parts is formed as a convex portion at one end of the exposure device in a fast scanning direction.

4. The image formation apparatus as claimed in claim 1, wherein the exposure device comprises an LED array.

5. The image formation apparatus as claimed in claim 1, wherein the positioning section positions the exposure device relative to the image formation apparatus main body in a fast scanning direction.

6. An image formation apparatus comprising:

an image formation apparatus main body;

a plurality of image formation units being provided detachably in the image formation apparatus main body, each of the image formation units comprising an image carrier, an exposure device that applies light to the image carrier for writing a latent image onto the image carrier, and a developing device that develops the latent image to form a toner image;

an intermediate transfer unit comprising an intermediate transfer body to which a toner image on the image carrier is transferred and a support member that supports the intermediate transfer body in the image formation apparatus main body; and a positioning section that positions the exposure device of each of the image formation units relative to the intermediate transfer unit, wherein the positioning section comprises: first positioning parts each formed in the exposure device; and a second positioning part formed in the support member, and the positioning section positions the exposure device relative to the intermediate transfer unit by causing the first positioning parts and the second positioning part to abut each other.

7. The image formation apparatus as claimed in claim 6, wherein the positioning section further comprises an urging member that urges each of the first positioning parts toward the second positioning part.

8. The image formation apparatus as claimed in claim 6, wherein each of the first positioning parts is formed as a convex portion at one end of the exposure device in a fast scanning direction.

9. The image formation apparatus as claimed in claim 6, wherein the exposure device comprises an LED array.

10. The image formation apparatus as claimed in claim 6, wherein the positioning section positions the exposure device relative to the image formation apparatus main body in a fast scanning direction.

* * * * *